US011737495B2

(12) United States Patent
Liu

(10) Patent No.: US 11,737,495 B2
(45) Date of Patent: Aug. 29, 2023

(54) ELECTRONIC CIGARETTE

(71) Applicant: Tuanfang Liu, Shenzhen (CN)

(72) Inventor: Tuanfang Liu, Shenzhen (CN)

(73) Assignee: ASPIRE NORTH AMERICA LLC

( * ) Notice: Subject to any disclaimer, the term of this patent is extended or adjusted under 35 U.S.C. 154(b) by 478 days.

(21) Appl. No.: 17/005,293

(22) Filed: Aug. 27, 2020

(65) Prior Publication Data

US 2021/0153558 A1 May 27, 2021

(30) Foreign Application Priority Data

Nov. 26, 2019 (CN) ..... 201911170158.2
Nov. 26, 2019 (CN) ..... 201922072924.3

(51) Int. Cl.
*A24F 40/485* (2020.01)

(52) U.S. Cl.
CPC ..... *A24F 40/485* (2020.01)

(58) Field of Classification Search
None
See application file for complete search history.

(56) References Cited

U.S. PATENT DOCUMENTS

2015/0144147 A1* 5/2015 Li ..... F22B 1/284 392/390
2016/0000145 A1* 1/2016 Liu ..... A24F 40/60 131/329
2016/0183592 A1* 6/2016 Liu ..... A24F 40/50 131/329
2017/0006920 A1* 1/2017 Liu ..... A24F 40/50
2019/0191769 A1* 6/2019 Qiu ..... A24F 40/485
2019/0200671 A1* 7/2019 Mishra ..... A24F 40/30

* cited by examiner

*Primary Examiner* — Philip Y Louie
*Assistant Examiner* — Miles A Simpson
(74) *Attorney, Agent, or Firm* — Matthias Scholl P.C.; Matthias Scholl

(57) ABSTRACT

An electronic cigarette including an atomization assembly and a battery assembly. The atomization assembly is disposed on the battery assembly. The atomization assembly includes a base seat. The battery assembly includes a copper threaded ring and a control panel. The base seat is in threaded connection to the copper threaded ring so that the atomization assembly is integrated with the battery assembly. The control panel includes a pneumatic switch disposed in an air passage of the electronic cigarette. When in use, the air passes through the air passage to activate the pneumatic switch to work.

3 Claims, 5 Drawing Sheets

ELECTRONIC CIGARETTE

CROSS-REFERENCE TO RELATED APPLICATIONS

Pursuant to 35 U.S.C. § 119 and the Paris Convention Treaty, this application claims foreign priority to Chinese Patent Application No. 201911170158.2 filed Nov. 26, 2019 and to Chinese Patent Application No. 201922072924.3 filed Nov. 26, 2019. The contents of all of the aforementioned applications, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, MA 02142.

BACKGROUND

The disclosure relates to an electronic cigarette.

Electronic cigarettes atomize nicotine-containing e-liquid.

Conventional electronic cigarettes comprise a switch button. The switch button may be touched by accident thus bringing bad user experience. In addition, the air intake process of the electronic cigarettes produces noise.

SUMMARY

The disclosure provides an electronic cigarette comprising an atomization assembly and a battery assembly. The atomization assembly is disposed on the battery assembly. The atomization assembly comprises a base seat; the battery assembly comprises a copper threaded ring and a control panel; the base seat is in threaded connection to the copper threaded ring so that the atomization assembly is integrated with the battery assembly; the control panel comprises a pneumatic switch disposed in an air passage of the electronic cigarette; and when in use, air passes through the air passage to activate the pneumatic switch to work.

The copper threaded ring comprises an air inlet and a spiral groove; and when in use, the air flows along the spiral groove.

The atomization assembly comprises a mouthpiece and a joint, the battery assembly comprises an electrode joint; the mouthpiece, the joint, and the electrode joint are disposed in the air passage and communicate with each other.

The atomization assembly further comprises a first seal ring, a first fixed ring, a rotatable cover, a silicone ring, a location rod, a spring, a center pillar, a second seal ring, a glass tube, an atomizer, a second fixed ring, and an insulation ring; the spring and the location rod are consecutively disposed in a location hole of the center pillar; the silicone ring is disposed on the center pillar; the first fixed ring is disposed in the rotatable cover; the first seal ring is disposed on the mouthpiece; the mouthpiece is connected to the first fixed ring; and the rotatable cover is disposed on the center pillar.

The second seal ring is wrapped around the center pillar; the center pillar is disposed in the glass tube; the atomizer is disposed in the center pillar; the second fixed ring is in threaded connection to the center pillar; the insulation ring and the joint are disposed on the base seat; and the base seat abuts against the second fixed ring.

The battery assembly further comprises an electrode insulator, a gasket, a cartridge, a battery cell, a silicone pad, and a bottom cover; the electrode insulator and the electrode joint are consecutively disposed on the copper threaded ring; the copper threaded ring is disposed on the cartridge; the control panel is disposed on the bottom cover; and the silicone pad is disposed on the control panel.

The positive and negative terminals of the control panel are connected to positive and negative terminals of the battery cell, respectively; the gasket is attached to the positive and negative terminals of the battery cell; the battery cell is disposed in the cartridge; and the bottom cover is secured to one end of the cartridge.

DETAILED DESCRIPTION

Figure 1:
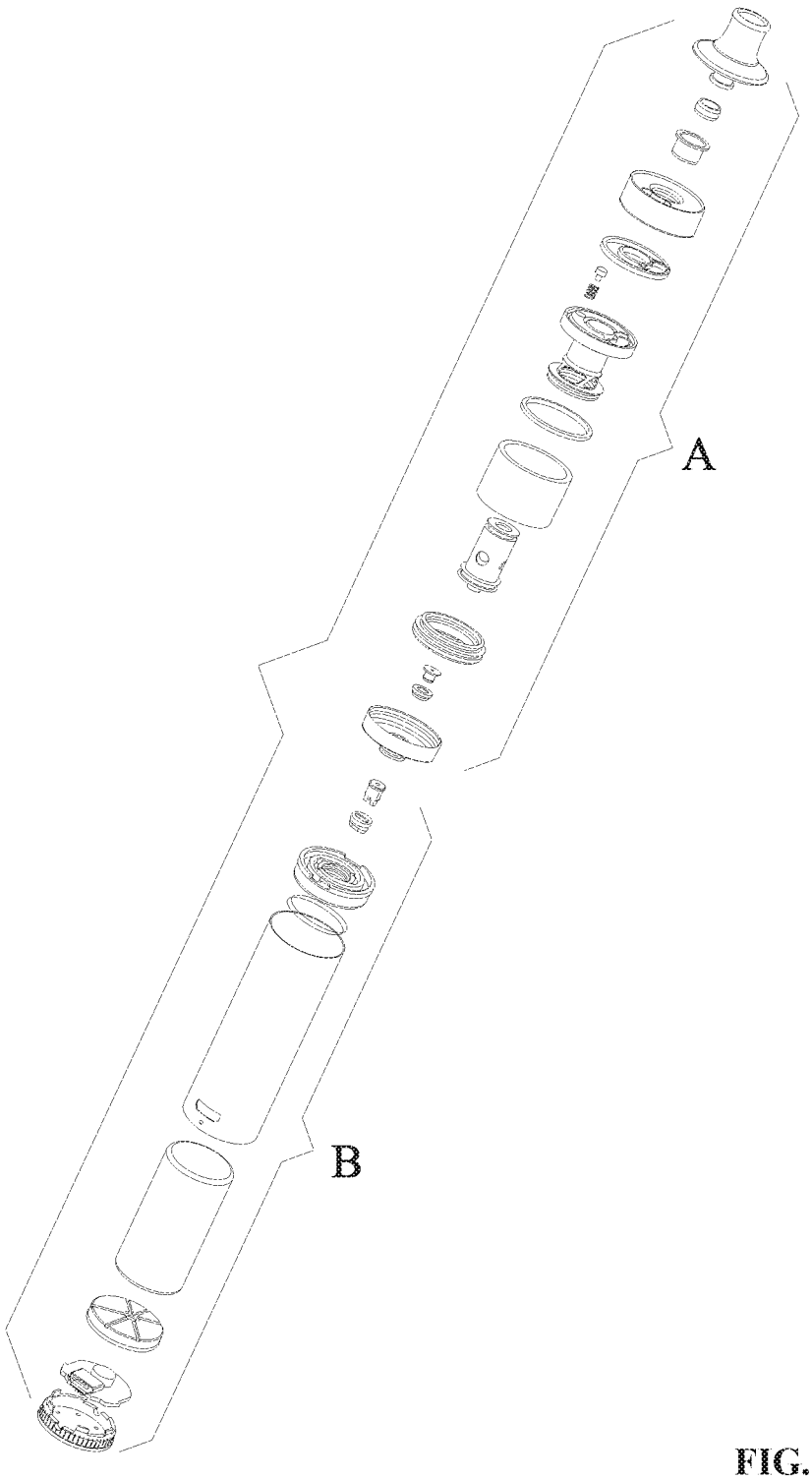
FIG. 1 is an exploded view of an electronic cigarette according to one embodiment of the disclosure.
Figure 2:
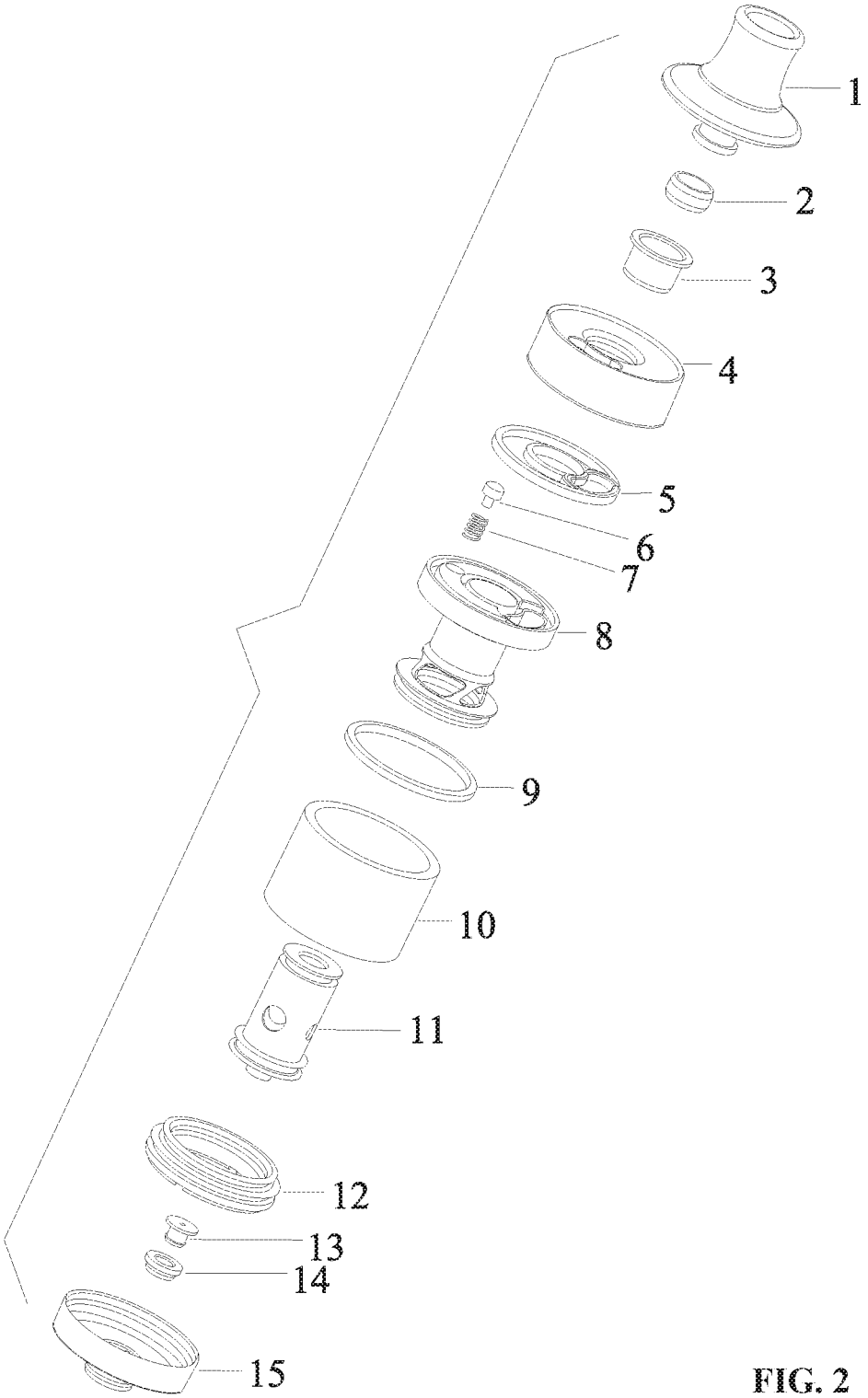
FIG. 2 is an exploded view of an atomization assembly of an electronic cigarette according to one embodiment of the disclosure.
Figure 3:
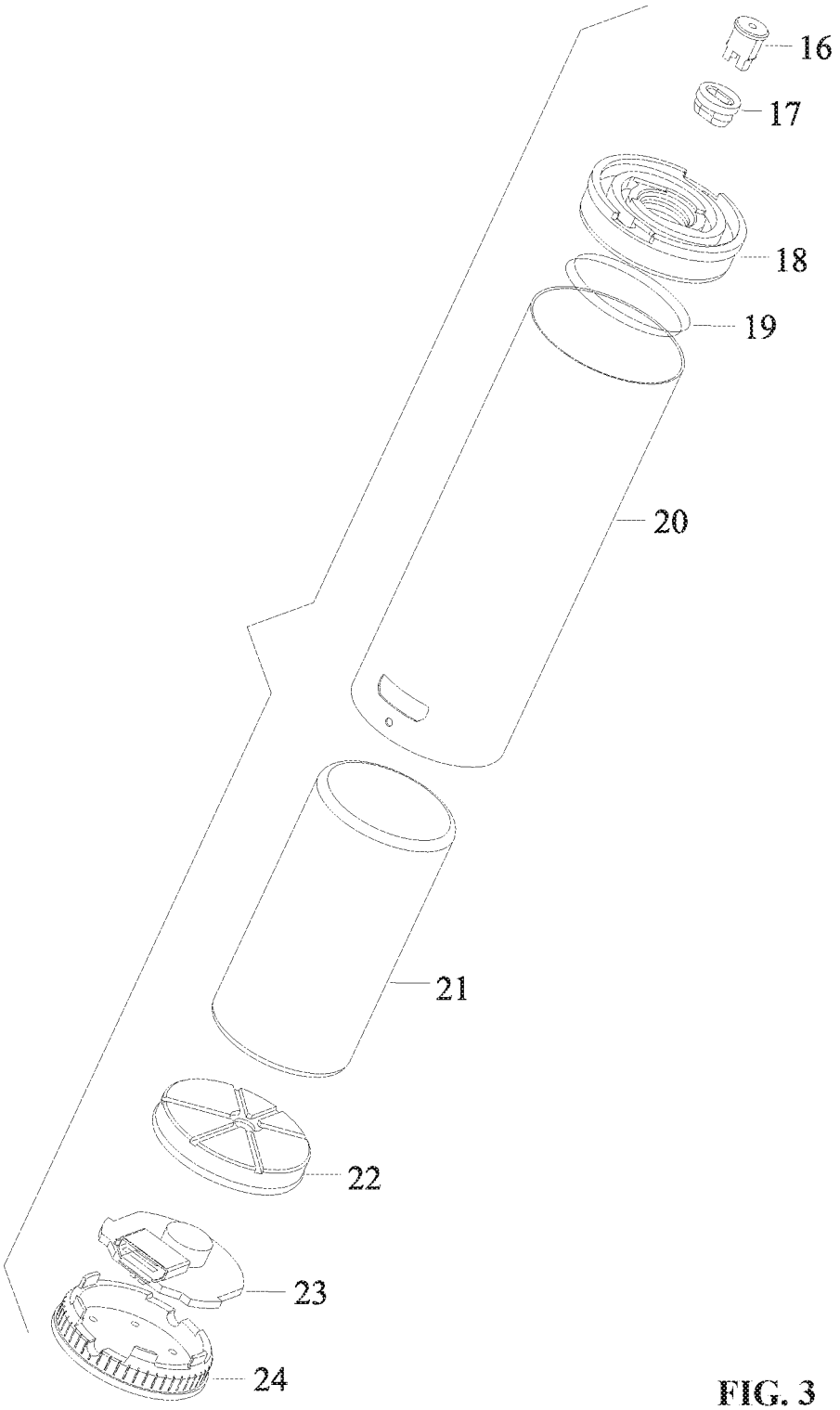
FIG. 3 is an exploded view of a battery assembly of an electronic cigarette according to one embodiment of the disclosure.
Figure 4:
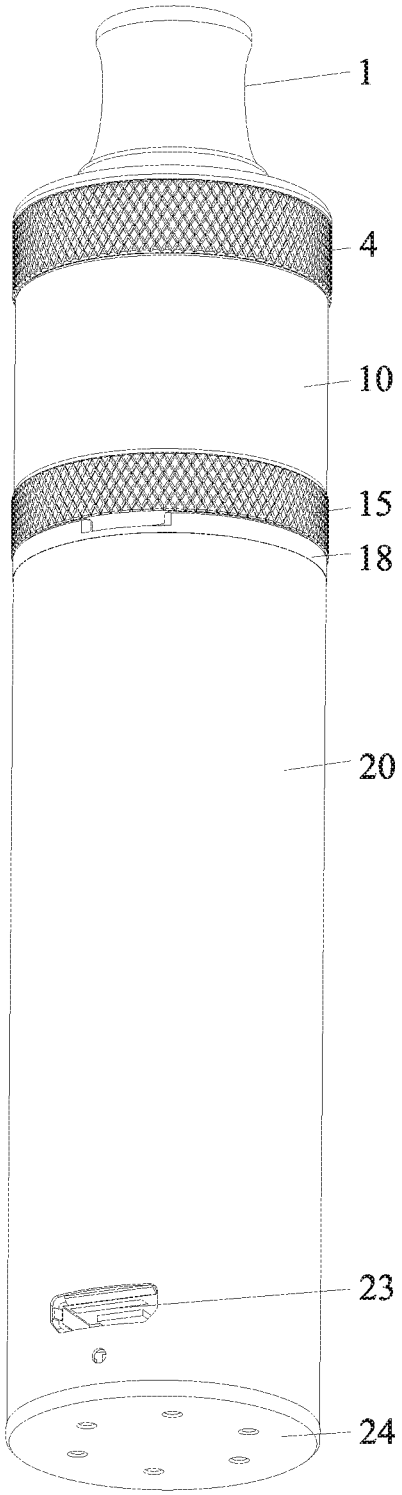
FIG. 4 is a schematic diagram of an electronic cigarette according to one embodiment of the disclosure.

To further illustrate, embodiments detailing an electronic cigarette are described below. It should be noted that the following embodiments are intended to describe and not to limit the disclosure.

As shown in FIGS. 1-5, an electronic cigarette comprises an atomization assembly A and a battery assembly B. The atomization assembly comprises: a mouthpiece 1, a first seal ring 2, a first fixed ring 3, a rotatable cover 4, a silicone ring 5, a location rod 6, a spring 7, a center pillar 8, a second seal ring 9, a glass tube 10, an atomizer 11, a second fixed ring 12, a joint 13, an insulation ring 14, and a base seat 15. The spring 7 and the location rod 6 are consecutively disposed in a location hole of the center pillar 8; the silicone ring 5 is disposed on the center pillar 8; the first fixed ring 3 is disposed in the rotatable cover 4; the first seal ring 2 is disposed on the mouthpiece 1; the mouthpiece 1 is connected to the first fixed ring 3; and the rotatable cover 4 is disposed on the center pillar 8. The second seal ring 9 is wrapped around the center pillar 8; the center pillar 8 is disposed in the glass tube 10; the atomizer 11 is disposed in the center pillar 8; the second fixed ring 12 is in threaded connection to the center pillar 8; the insulation ring 14 and the joint 13 are disposed on the base seat 15; and the base seat 15 abuts against the second fixed ring 12. The mouthpiece 1, the joint 13, and the electrode joint 16 are aligned with each other in the air passage and communicate with each other. When in use, the air passes through the air passage to activate the pneumatic switch on the control panel 23 to work.

The battery assembly B comprises an electrode joint 16, an electrode insulator 17, a copper threaded ring 18, a gasket 19, a cartridge 20, a battery cell 21, a silicone pad 22, the control panel 23, and a bottom cover 24; the electrode insulator 17 and the electrode joint 16 are consecutively disposed on the copper threaded ring 18; the copper threaded ring 18 is disposed on the cartridge 20; the control panel 23 is disposed on the bottom cover 24; and the silicone pad 22 is disposed on the control panel 23. The positive and negative terminals of the control panel 23 are connected to positive and negative terminals of the battery cell 21, respectively; the gasket 19 is attached to the positive and negative terminals of the battery cell 21; the battery cell 21 is disposed in the cartridge 20; and the bottom cover 24 is secured to one end of the cartridge 20. The atomization assembly is disposed on the battery assembly. The base seat 15 is in threaded connection to the copper threaded ring 18 so that the atomization assembly is integrated with the battery assembly. The copper threaded ring 18 comprises two air inlets and a spiral groove; and when in use, the air flows along the spiral groove and no noise is produced. The cartridge 20 of the battery assembly includes no switch button. The pneumatic switch is activated to work when there is an air flow passing through the pneumatic switch. The electronic cigarette is light and handy, and when a user holds the electronic cigarette in the hand, the air inlet will not be blocked. Because the electronic cigarette has no switch button, so it will not work by accident in the non-use state.

Figure 5:
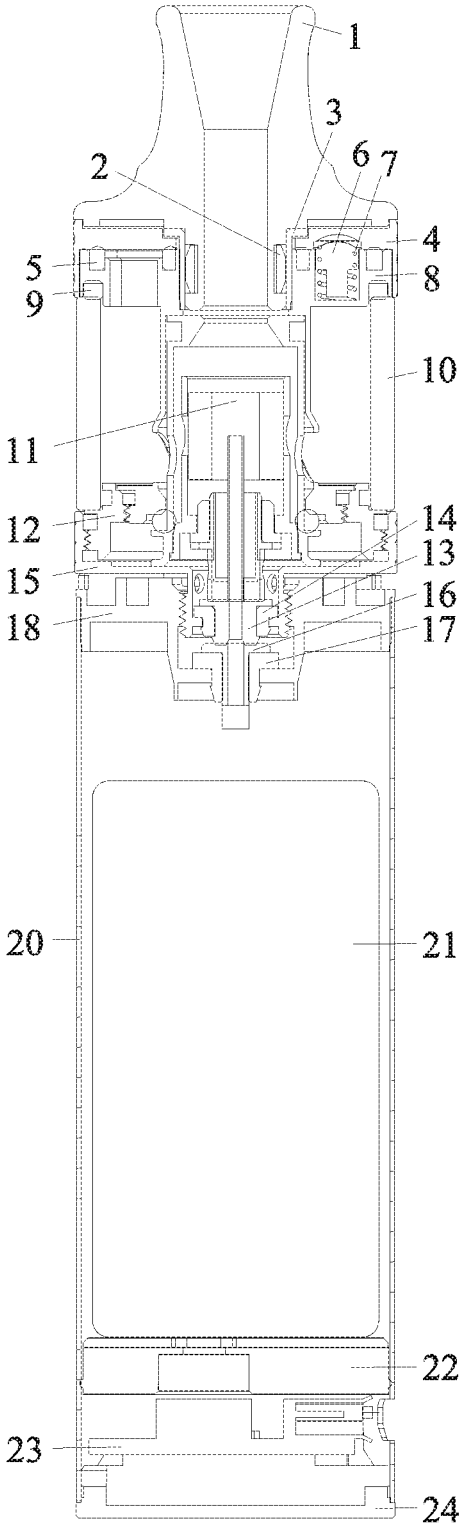
FIG. 5 is a sectional view of an electronic cigarette according to one embodiment of the disclosure.

The arrow in FIG. 5 shows the flow direction of the air.

The following advantages are associated with the electronic cigarette of the disclosure:

1. The mouthpiece, the joint, and the electrode joint are aligned with each other in the air passage and communicate with each other. When in use, the air passes through the air passage to activate the pneumatic switch on the control panel to work.

2. The copper threaded ring comprises two air inlets and a spiral groove; and when in use, the air flows along the spiral groove and no noise is produced.

3. The electronic cigarette is light and handy and has no switch button. When a user holds the electronic cigarette in the hand, the air inlet will not be blocked, and the electronic cigarette will not work by accident in the non-use state.

It will be obvious to those skilled in the art that changes and modifications may be made, and therefore, the aim in the appended claims is to cover all such changes and modifications.

What is claimed is:

1. An electronic cigarette, comprising a battery assembly, and an atomization assembly being disposed on the battery assembly; wherein:

the atomization assembly comprises a base seat, a mouthpiece, a joint, a first seal ring, a first fixed ring, a rotatable cover, a silicone ring, a location rod, a spring, a center pillar, a second seal ring, a glass tube, an atomizer, a second fixed ring, and an insulation ring;

the battery assembly comprises a copper threaded ring, a control panel, and an electrode joint;

the base seat is in threaded connection to the copper threaded ring so that the atomization assembly is integrated with the battery assembly;

the control panel comprises a pneumatic switch disposed in an air passage of the electronic cigarette;

when in use, air passes through the air passage to activate the pneumatic switch to work;

the copper threaded ring comprises an air inlet and a spiral groove, and when in use, the air flows along the spiral groove;

the mouthpiece, the joint, and the electrode joint are disposed in the air passage and communicate with each other;

the spring and the location rod are consecutively disposed in a location hole of the center pillar;

the silicone ring is disposed on the center pillar;

the first fixed ring is disposed in the rotatable cover;

the first seal ring is disposed on the mouthpiece;

the mouthpiece is connected to the first fixed ring;

the rotatable cover is disposed on the center pillar;

the second seal ring is wrapped around the center pillar;

the center pillar is disposed in the glass tube;

the atomizer is disposed in the center pillar;

the second fixed ring is in threaded connection to the center pillar;

the insulation ring and the joint are disposed on the base seat; and the base seat abuts against the second fixed ring.

2. The electronic cigarette of claim 1, wherein the battery assembly further comprises an electrode insulator, a gasket, a cartridge, a battery cell, a silicone pad, and a bottom cover; the electrode insulator and the electrode joint are consecutively disposed on the copper threaded ring; the copper threaded ring is disposed on the cartridge; the control panel is disposed on the bottom cover; and the silicone pad is disposed on the control panel.

3. The electronic cigarette of claim 2, wherein positive and negative terminals of the control panel are connected to positive and negative terminals of the battery cell, respectively; the gasket is attached to the positive and negative terminals of the battery cell; the battery cell is disposed in the cartridge; and the bottom cover is secured to one end of the cartridge.

* * * * *